US007101008B2

(12) United States Patent
Ikeda

(10) Patent No.: US 7,101,008 B2
(45) Date of Patent: Sep. 5, 2006

(54) PRINTING APPARATUS

(75) Inventor: Toshihiko Ikeda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 36 days.

(21) Appl. No.: 10/947,353

(22) Filed: Sep. 23, 2004

(65) Prior Publication Data

US 2005/0093905 A1 May 5, 2005

(30) Foreign Application Priority Data

Sep. 29, 2003 (JP) ..... 2003-336997

(51) Int. Cl.
*B41J 29/38* (2006.01)

(52) U.S. Cl. ..... 347/14; 347/19

(58) Field of Classification Search ..... 347/7
See application file for complete search history.

(56) References Cited

U.S. PATENT DOCUMENTS 5,663,750 A * 9/1997 Sakuma ..... 347/7
5,911,526 A * 6/1999 Watanabe ..... 400/74
6,312,177 B1 * 11/2001 Nureki ..... 400/578

FOREIGN PATENT DOCUMENTS

JP A 2003-72105 3/2003

* cited by examiner

*Primary Examiner*—Thinh Nguyen
(74) *Attorney, Agent, or Firm*—Oliff & Berridge, PLC

(57) ABSTRACT

Provided is a printing apparatus having a device which is capable of intuitively deciding whether the indication of printing start is possible. Platen installation (S10), ink cartridge installation (S20), residual ink amount (S30), waste ink tank installation (S40), residual capacity of waste ink tank (S50), printing data reception (S60), and maintenance execution (S70) are confirmed, as conditions at which printing can be conducted, with a platen detection sensor, ink cartridge detection sensor, residual ink amount detection sensor, water ink tank detection sensor, residual capacity of waste ink tank detection sensor, reception flag, and maintenance flag, respectively, and a printing possibility LED provided in a printing start button is switched on at the point of time when all the printing possibility-conditions are satisfied (S90).

7 Claims, 4 Drawing Sheets

PRINTING APPARATUS

BACKGROUND OF THE INVENTION

1. Field of the Invention

The present invention relates to a printing apparatus of an ink-jet system or the like.

2. Description of the Related Art

In printing apparatuses of an ink jet system which conduct recording by ejecting ink on a recording medium, the ink is generally supplied to a plurality of ejection channels of an ink jet head from an ink supply source, an actuator such as a heat generating element or piezoelectric element is selectively actuated, and the ejection of ink is carried out from an ejection nozzle provided at the distal end of the ejection channels. In such a printing apparatus, printing is typically conducted on paper or the like serving as a recording medium, but recording is also sometimes conducted on cloth such as T-shirts.

When printing is conducted on paper or the like, if the user inputs a printing command from an external equipment such as a personal computer connected to the printing apparatus, printing is usually executed without conducting any operations at the printing apparatus. However, for example, when the residual amount of ink is small, this is detected by an appropriate method, the user is informed about it, and printing processing is carried out after the ink cartridge is replaced. For example, Japanese Patent Application Laid-open No. 2003-72105 discloses a configuration in which an ink cartridge state display LED is prepared and comes on if the residual amount of ink becomes small or when the ink supply is disrupted or the ink cartridge is not properly inserted.

On the other hand, when printing is conducted on cloth such as a T-shirt, in most configurations the recording medium has to be strongly fixed to a holding device such as a platen, printing has to be executed after confirming that the printing is possible at the printing apparatus side, and printing cannot be automatically started merely by the printing command from the external equipment. In such printing apparatuses for printing on cloth, an indication device such as a button for indicating the printing start is provided, and the user starts printing by pushing the printing start button after confirming that several conditions are satisfied, those conditions relating to the residual amount of ink, completion of printing data reception, installation of waste ink tank, fixing of the recording medium, and the like.

However, information on whether the conditions required for printing start have been satisfied has to be confirmed by displaying at separate LED lamps or liquid-crystal displays, and as the number of conditions increases, the number of items that have to be confirmed also rises, making the procedure inconvenient for the user.

SUMMARY OF THE INVENTION

The present invention was created to resolve the above-described problems and it is an object thereof to provide a printing apparatus having a device which is capable of intuitively deciding whether the indication of printing start is possible.

In order to attain this object, the present invention provides a printing apparatus for printing printing data received from an external equipment, this apparatus comprising a printing possibility condition decision device for deciding as to whether or not the conditions at which printing of the printing data is possible have been satisfied, a display device for displaying the decision results obtained with the printing possibility condition decision device, and a printing start indication device for indicating the printing start, wherein the display device is a light-emitting member provided in the printing start indication device or in the vicinity thereof, and printing of the printing data is executed if the printing start is indicated by the printing start indication device.

Further, the printing apparatus in accordance with the present invention comprises a data storage device for storing the printing data, wherein the printing possibility condition decision device does not make a decision that printing is possible when at least part of the printing data has not been accumulated in the data storage device.

Further, the printing apparatus in accordance with the present invention comprises error informing device for informing about an error in case the printing start is indicated by the printing start indication device when the printing possibility condition decision device has not decided that printing is possible.

With the printing apparatus in accordance with the present invention, a display device which is a light-emitting member emits light when the conditions relating to printing possibility have been satisfied. Therefore, the user can indicate printing by confirming the light-emission state of the display device even when the number of conditions relating to printing possibility is large, and the operations can be conducted easily even by an unskilled user. Furthermore, because the display device is provided in the printing start indication device or in the vicinity thereof, the printing start indication device can be operated by intuitively checking the display device.

Further, if a condition as to whether or not the printing data has been received in a volume sufficient for printing is set as one of the conditions relating to printing possibility, then it is not necessary to monitor the reception of printing data and the printing start indication device can be operated by intuitively checking the display device, as with the other conditions relating to printing possibility.

Furthermore, the printing start indication device can be made inoperable unless the display device emits light, but even if it is operable and operated when the printing was not considered possible, if an error message is produced, the user can wait till the display device is actuated after receiving the error message.

DESCRIPTION OF THE PREFERRED EMBODIMENTS

Figure 1:
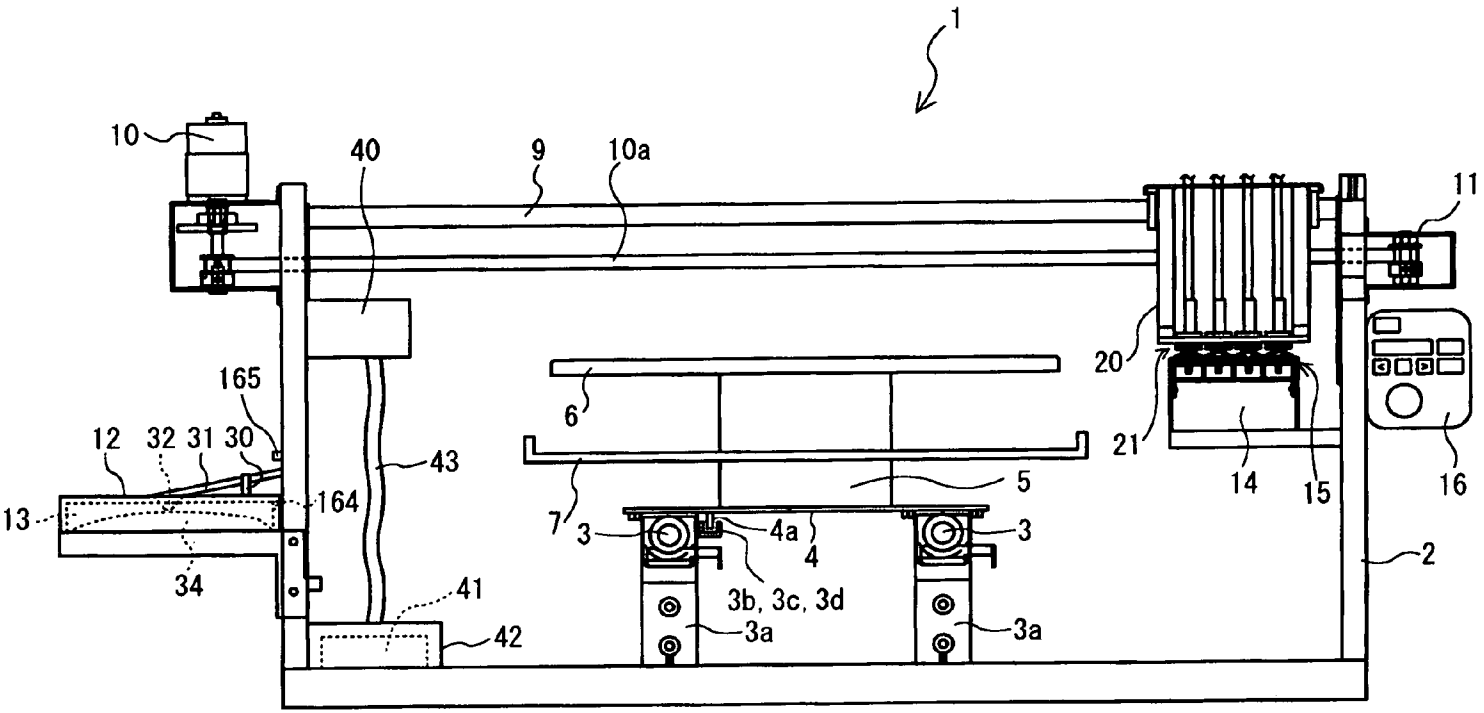
FIG. 1 is a front view of the ink-jet printer 1.

The preferred embodiments of the present invention will be described hereinbelow with reference to the appended drawings. First, the entire configuration of the ink-jet printer 1 which is an example of a printing device will be described with reference to FIG. 1. FIG. 1 is a front view of the ink-jet printer 1. The direction of the paper surface in FIG. 1 is a front direction of the ink-jet printer 1.

As shown in FIG. 1, the ink-jet printer 1 comprises a casing 2 almost in the form of a rectangular parallelepiped for which the front-rear direction is a longitudinal direction. Two rails 3 oriented in the front-rear direction are arranged side by side in almost the center of the bottom surface of the casing 2. The two rails 3 are supported on respective base portions 3*a* rising in the vertical direction from the casing 2. A plate-like platen support base 4 which can move in the front-rear direction of the casing 2 along the rails 3 is supported on top of the rails 3. A replaceable platen 6 is fixed to the upper end of a support column 5 which rises vertically in almost the center of the platen support base 4.

The platen 6 is an almost rectangular plate, in a plan view thereof, with a front-rear direction of the casing 2 serving a longitudinal direction, and is designed for carrying horizontally a medium for recording composed of cloth, for example, a T-shirt. An antisliding member (not shown in the figure) is provided at the upper surface of the platen 6 in order to prevent the T-shirt or the like from being displaced during printing, the printing surface of the T-shirt or the like being in a stretched condition. Further, edges at both sides of the platen 6 in the longitudinal direction are provided in a protruding condition, so as to obtain a trapezoidal shape. The platen 6 is replaced according to the size of the T-shirt or the like which is the medium for recording. A platen detection sensor 161 (see FIG. 3) composed of a photosensor is provided at the support column 5, and if the platen 6 is installed, it is detected by the platen detection sensor 161.

A tray 7 which is fixed to the support column 5 in a position almost in the middle between the platen 6 and the platen support base 4 has a bottom surface almost parallel to the upper surface of the platen 6, and is constructed so that the periphery thereof, in a plan view, is larger than that of the platen 6. This tray 7 is necessary to prevent a T-shirt from falling to the bottom surface of the casing 2 even when the T-shirt or the like is inadvertently dropped by the user from the platen 6 when it is placed on the platen 6.

As shown in FIG. 1, a platen motor 8 (see FIG. 3) for moving the platen support base 4 in the front-rear direction of the casing 2 is provided in the vicinity of the rear end (the end portion of the rail 3 located at the back surface side of the casing 2) of the rail 3. A drive belt (not shown in the figure) is stretched between the drive shaft of the platen motor 8 and a pulley provided in the vicinity of the front end (the end portion of the rail 3 located at the front surface side of the casing 2) of the rail 3. The platen support base 4 which is fixed to this belt can move reciprocally in the front-rear direction of the casing 2 along the rails 3 when driven by the platen motor 8. A photosensor 3*b* for detecting that the platen 6, which moves from the back surface toward the front surface of the casing 2 during printing or reading, is in the end point in the movement direction is provided in the vicinity of the front end of the rail 3. Further, a photosensor 3*c* for detecting that the platen 6 is in the initial point in the movement direction during printing and a photosensor 3*d* for detecting that the platen 6 is in the initial point during reading are provided in the vicinity of the rear end of the rail 3. The photosensors 3*b*–3*d* comprise a light-emitting unit and a light-receiving unit (not shown in the figure), and detect the detection object based on whether the light emitted by the light-emitting portion has been received by the light-receiving unit. A shielding plate 4*a* for intersecting the space between the light-emitting units and light-receiving units of the photosensors 3*b*–3*d* and conducting the detection of the position of the platen 6 with the photosensors 3*b*–3*d* is provided in a protruding condition at the lower surface of the platen support base 4. The platen motor 8 is a stepping motor, and detection of the position of the platen 6 based on the drive control of the platen motor 8 is carried out with reference to the position of the initial point or end point of the platen 6 detected by the insertion of the shielding plate 4*a* between the light-emitting units and light-receiving units of those photosensors 3*b*–3*d*.

As shown in FIG. 1, a guide rail 9 for guiding the movement of a carriage 20 which carries an ink-jet head 21 is provided so as to hang between the both side surfaces of the casing 2 in a position above the platen 6, almost in the center of the casing 2 in the front-rear direction thereof. A carriage belt 10*a* provided so as to hang between a carriage motor 10 provided in the vicinity of the left end of the guide rail 9 and a pulley 11 provided in the vicinity of the right end is disposed from left to right of the casing 2 in a position below the guide rail 9. The carriage belt 10*a* is fixed to the back surface of the carriage 20, and the carriage 20 is driven by the carriage motor 10 reciprocally in the left-right direction of the casing 2 along the guide rail 9 coupled to a coupling unit provided at the same back surface. The carriage motor 10 is a DC motor, and the position of the carriage 20 is detected based on the output from a linear encoder (not shown in the figure) provided at the guide rail 9.

The carriage 20 has a shape close to that of a rectangular parallelepiped. As shown in FIG. 1, four ink-jet heads 21 of a piezoelectric system are carried on the bottom surface thereof. The four ink-jet heads 21 are provided, for example, correspondingly to color inks of four colors: cyan, magenta, yellow, and black, and each of them is provided, for example, with 128 channels (not shown in the figure) for ejecting the respective inks. Further, each channel is provided with a piezoelectric actuator (not shown in the figure) which is driven separately and the actuators are controlled so that droplets of ink are ejected downwardly from fine ejection nozzles (not shown in the figure) formed in the bottom surface of the ink-jet head 21 correspondingly to each channel.

A total of four cartridge accommodation portions 12 for detachably accommodating the ink cartridges 13 in the form of an almost rectangular parallelepiped containing the inks are provided in a row in the front-rear direction of the casing 2 at the left side surface of the ink-jet printer 1, as shown in FIG. 1. The ink cartridges 13 are inserted into the cartridge accommodation portions 12 from the side of the casing 2 toward the casing 2. An ink cartridge detection sensor 164 composed of a photosensor is provided at the casing 2 at the side thereof which faces the inside of the cartridge accommodation portion 12, and if the ink cartridge 13 is installed, the light shielding portion (not shown in the figure) provided in the ink cartridge 13 penetrates between the light-emitting unit and light-receiving unit of the ink cartridge detection sensor 164 and the installation of the ink cartridge 13 is detected.

An ink pack 34 is accommodated in each ink cartridge 13, and the ink packs 34 are respectively connected to each ink jet head 21 with tubes (not shown in the figure) for supplying the inks to the channels. Furthermore, an arm 30 whose shape is like one of Japanese katakana characters "ユ", in the side view is provided above the cartridge accommodation portion 12, and a total of four rod-like ink residual amount detection members 31 are pivotally supported above each cartridge accommodation portion 12 so that the members are free to rotate in the arm 30. Each ink residual amount detection member 31 has an almost triangular detection portion 32 formed from a resin at a front end thereof, and ink residual amount detection sensors 165 composed of photosensors are provided at the side surface of the casing above the rear end portion of the ink residual amount detection members 31. The detection portions 32 are inserted into ink cartridges 13 via an opening provided in almost the center of the upper portion of each cartridge accommodation portion 12 and the ink cartridge 13 and are brought into contact with the ink packs 34. If the ink present in the ink pack is consumed, the ink pack shrinks, the detection portion 32 is lowered, and the rear end of the ink residual amount detection members 31 rises and penetrates between the light-emitting unit and light-receiving unit of the ink residual amount detection sensor 165, indicating that the residual amount of ink has decreased.

A maintenance unit 14 having suction caps 15 that can be attached to the nozzle surface of each ink jet head 21 and detached therefrom is provided in a position to which carriage 20 moves at the right end of the casing 2. The maintenance unit 14 is provided with a suction pump (not shown in the figures), and when the suction caps 15 are attached to the ink-jet head 21, the ink can be sucked in via the suction caps 15. Further, when no printing is carried out, the nozzle surface of the ink-jet head 21 is covered with the suction caps 15 and the ink is prevented from drying.

A flushing unit 40 for conducting flushing from each ink-jet head 21 is provided in a position to which the carriage 20 moves at the left side of the casing 2. A waste ink tank accommodation unit 42 for the installation of a waste ink tank 41 is provided below the flushing unit 40, and the waste ink tank 41 is connected to the flushing unit 40 with a tube 43 and to the maintenance unit 14 with another tube (not shown in the figure) and is used for storing the waste ink discharged by suction of the ink by flushing or purging. The waste ink tank 41 is of a detachable system and when it is installed in the waste ink tank accommodation unit 42, a waste ink tank detection sensor 162 composed of a photosensor (see FIG. 3) is actuated. Furthermore, the waste ink tank 41 is impelled upward by a spring inside the waste ink tank accommodation unit 42, and if the amount of waste ink in the waste ink tank 41 increases, the waste ink tank moves down under the effect of the ink weight, thereby actuating a waste ink tank residual capacity detection sensor 163 (see FIG. 3).

Figure 2:
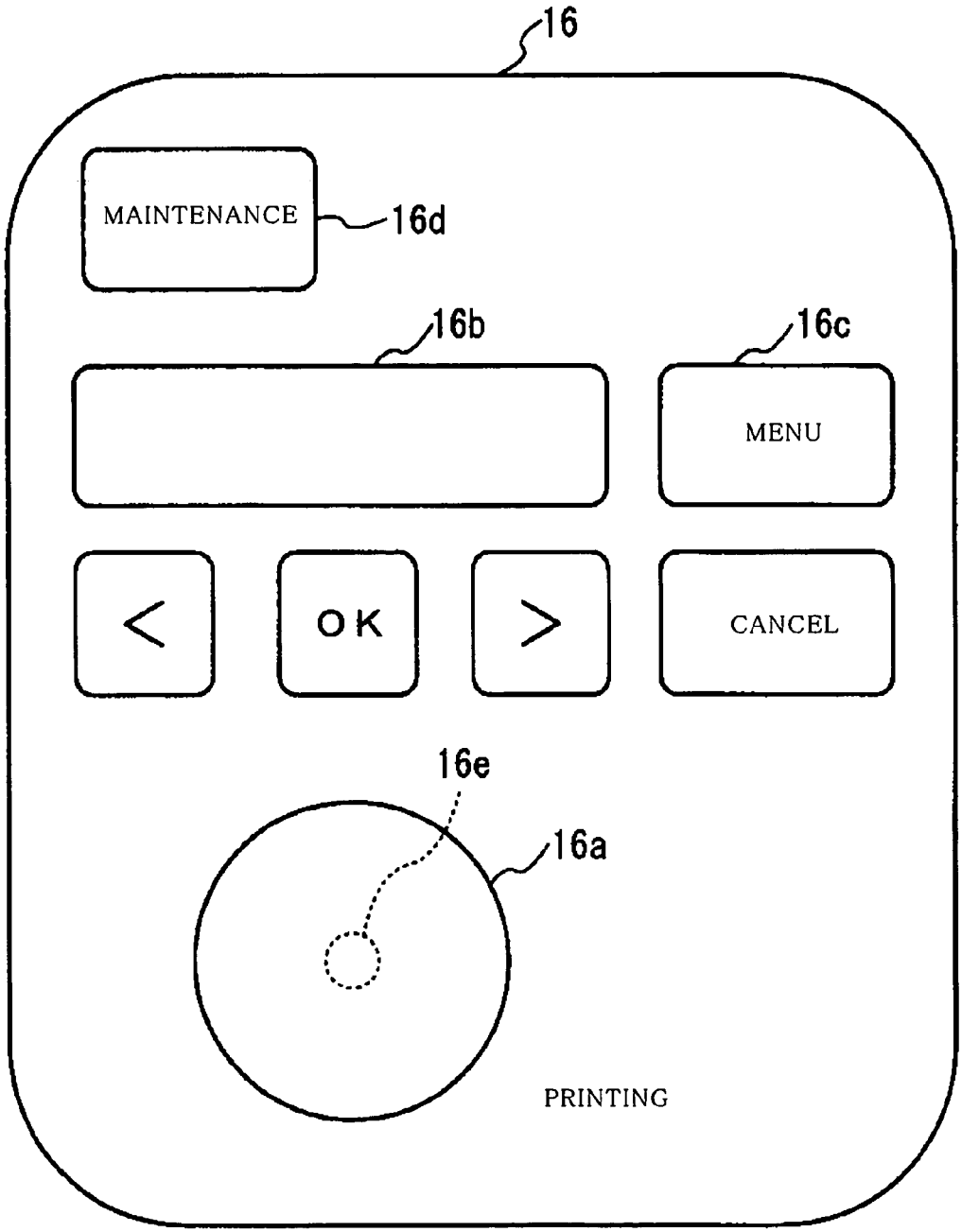
FIG. 2 is a front view of the control panel 16.

Further, a control panel 16 for controlling the operation of the ink-jet printer 1 is provided in a position at the right side surface at the front surface of the casing 2. FIG. 2 is a front view of the control panel 16. As shown in FIG. 2, in the control panel 16, there are provided a plurality of buttons such as a printing start button 16*a* which is printing start indication device, a menu button 16*c*, and a maintenance button 16*d*, and a liquid crystal display (referred to hereinbelow as LCD) 16*b* for displaying the menu and various modes. The printing start button 16*a* is provided with a printing possibility LED (display device) 16*e* which comes on when printing is possible. If a decision is made that printing is possible, the printing possibility LED 16*e* comes on, and the entire printing start button 16*a* appears to be lighted up. The printing possibility LED 16*e* may be provided in close vicinity to the printing start button 16*a*, rather than in the printing start button 16*a* itself.

Figure 3:
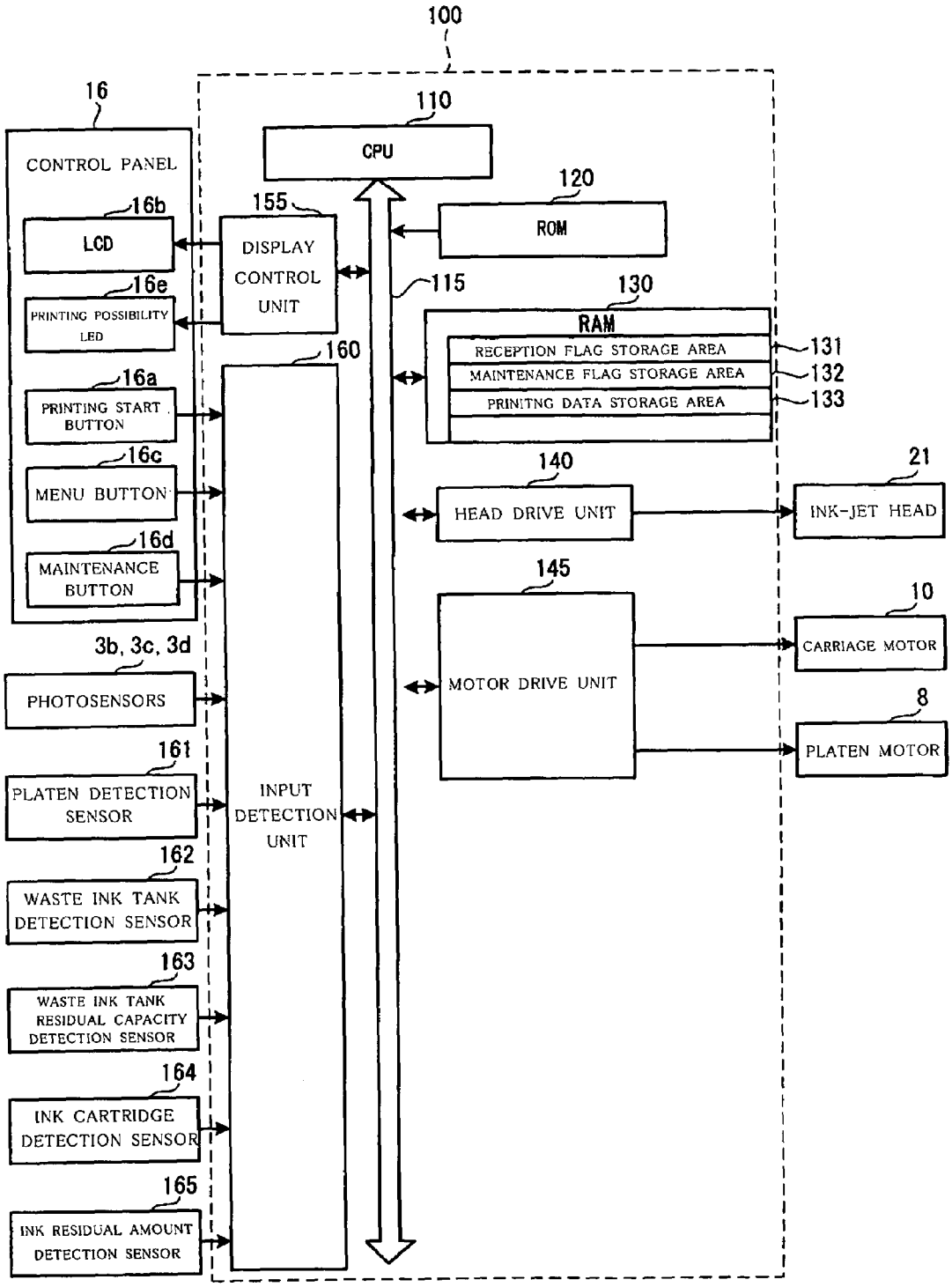
FIG. 3 is a block diagram illustrating the electric configuration of the ink-jet printer 1.

The electric configuration of the ink-jet printer 1 will be explained hereinbelow with reference to FIG. 3. FIG. 3 is a block diagram illustrating the electric configuration of the ink-jet printer 1. As shown in FIG. 3, a control unit 100 of the ink-jet printer 1 is provided with a CPU 110 for controlling the entire ink-jet printer 1. A ROM 120 storing a variety of control programs executable by the CPU 110 and a RAM 130 for temporarily storing data are connected to the CPU 110 via the bus 115. The RAM 130 is provided with a reception flag storage area 131 for storing the reception flag which is set ON when printing data are received, a maintenance flag storage area 132 for storing a maintenance flag which is set ON when the maintenance button 16*d* is pushed down and maintenance is executed, and a printing data storage area 133 serving as a data storage device for storing the received printing data. Furthermore, a head drive unit 140 for driving piezoelectric actuators provided in each channel of the ink-jet head 21, and a motor drive unit 145 for driving the carriage motor 10 and platen motor 8 are connected via a bus 115 to the CPU 110.

Further, a display control unit 155 for displaying the menu, error informing or the like at the LCD 16*b* and switching on the printing possibility LED 16*e* and an input detection unit 160 are connected via the bus 115 to the CPU 110. Photosensors 3*b*–3*d*, a variety of sensors for making a decision on conditions relating to printing possibility, that is, the platen detection sensor 161, waste ink tank detection sensor 162, waste ink tank residual capacity detection sensor 163, ink cartridge detection sensor 164, and ink residual amount detection sensor 165, and printing start button 16*a*, menu button 16*c*, maintenance button 16*d* and various other buttons provided at the control panel 16 are connected to the input detection unit 160.

The operation of the ink-jet printer 1 having the above-described configuration will be explained hereinbelow. If a power source of the ink-jet printer 1 is turned on, the control program stored in the ROM 120 is read and initial setting processes of various kinds are carried out. If printing data is transmitted from an external equipment, it is stored in the printing data storage area 133. The user places a T-shirt or the like, which is the recording medium, on the platen 6, waits till the conditions relating to printing possibility are satisfied and the printing possibility LED 16*e* comes on, and if the printing possibility LED 16*e* comes on, the user pushes down the printing start button 16*a*. As a result, the printing operation is executed. Thus, the platen motor 8 is driven and the platen 6 is moved once to the starting point (position detected with the photosensor 3*c*) of printing at the back surface side of the casing 2. Then, the platen 6 is moved at a constant speed toward the end point (position detected with the photosensor 3*b*), the carriage 20 is reciprocally moved in the direction perpendicular to the movement direction of the platen 6, following the movement of the platen 6, and the ejection of ink droplets from the ink-jet head 21 is carried out according to the printing data.

Figure 4:
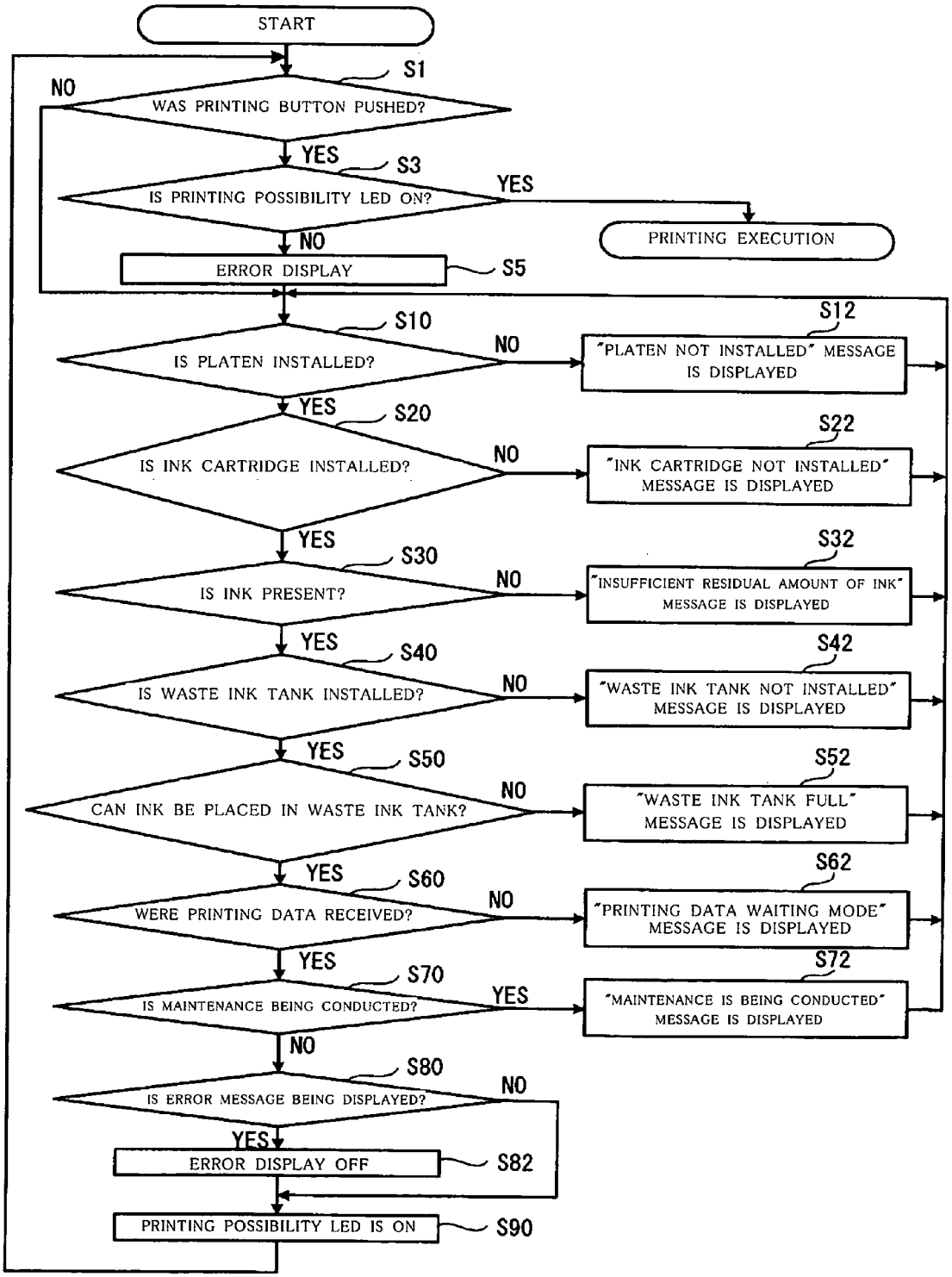
FIG. 4 is a flow chart illustrating the flow of the process of making a decision with respect to conditions relating to printing possibility.

The process of making a decision on conditions relating to printing possibility for switching on the printing possibility LED 16*e* will be explained hereinbelow with reference to the flow chart shown in FIG. 4. FIG. 4 is a flow chart illustrating the flow of the process of making a decision on conditions relating to printing possibility.

As shown in FIG. 4 if a process of making a decision on conditions relating to printing possibility is started, first, a decision is made as to whether or not the printing start button 16*a* has been pushed (S1). If the printing start button 16*a* has not been pushed (S1: NO), the processing flow proceeds to S10. If the printing start button 16*a* has been pushed (S1: YES), a decision is made as to whether or not the printing possibility LED 16*e* has come on (S3). If the printing possibility LED 16*e* has come on (S3: YES), printing processing is executed according to the printing data stored in the printing data storage area 133. If the printing possibility LED 16*e* has not come on (S3: NO), it can be considered that the user has erroneously pushed the printing start button 16*a* when preparation of printing has not yet been made. Therefore, an error message "PLEASE WAIT TILL THE PRINTING START BUTTON LIGHT COMES ON" or the like appears on the LCD 16*b* of the control panel 16 (S5). The user may be also informed about the error by a sound.

A decision is then made as to whether or not the platen 6 has been installed (S10). This is done by deciding as to whether or not there is an input from the platen detection sensor 161 provided on the support column 5. If the platen 6 has not been installed (S10: NO), a "PLATEN NOT INSTALLED" message or the like is displayed on the LCD 16*b* (S12) and the processing flow returns to S10.

If the platen 6 has been installed (S10: YES), a decision is then made as to whether or not the ink cartridge 13 has been installed (S20). This is done by deciding as to whether or not there are the inputs from all the four ink cartridge detection sensors 164. If the ink cartridge 13 has not been installed, (S20: NO), an "INK CARTRIDGE NOT INSTALLED" message or the like is displayed on the LCD 16*b* (S22) and the processing flow returns to S10.

If the ink cartridge 13 has been installed (S20: YES), a decision is then made as to whether or not the residual amount of ink is sufficient (S30). Thus, a decision is made that a cartridge with an insufficient amount of ink is present when a signal is inputted even from one of the four ink residual amount detection sensors 165. If the residual amount of ink is insufficient (S30: NO), a "RESIDUAL AMOUNT OF INK IS INSUFFICIENT" message or the like is displayed on the LCD 16*b* (S32) and the processing flow returns to S10.

If the residual amount of ink is sufficient (S30: YES), a decision is then made as to whether or not the residual ink tank 41 has been installed (S40). This is done by deciding as to whether or not there is an input from the waste ink tank detection sensor 162 provided in the waste ink tank accommodation unit 42. If the waste ink tank 41 has not been installed (S40: NO), a "WASTE INK TANK NOT INSTALLED" message or the like is displayed on the LCD 16*b* (S42) and the processing flow returns to S10.

If the waste ink tank 41 has been installed (S40: YES), a decision is then made as to whether or not the waste ink can be accommodated in the waste ink tank 41 (S50). This is done by deciding as to whether or not there is an input from the waste ink tank residual amount detection sensor 163. If the waste ink tank 41 is full (S50: NO), a "WASTE INK TANK FULL" message or the like is displayed on the LCD 16*b* (S52) and the processing flow returns to S10.

If the waste ink tank 41 still can accommodate ink (S50: YES), a decision is then made as to whether or not the reception of printing data has been completed (S60). This is done by deciding as to whether or not "1" has been stored in the reception flag storage area 131 of the RAM 130 and the reception flag has been set ON. Here, it is not necessary for all the printing data to be received, and a configuration may be used such that the reception flat is set ON when printing data allowing the printing to be started have been received. If the printing data have not yet been received (S60: NO), the "PRINTING DATA WAITING MODE" message or the like is displayed on the LCD 16*b* (S62) and the processing flow returns to S10.

If the printing data have been received (S60: YES), a decision is then made as to whether or not maintenance is being conducted (S70). This is done by deciding as to whether or not "1" has been stored in the maintenance flag storage area 132 of the RAM 130 and the maintenance flag has been set ON. The maintenance flag is set ON when the maintenance button 16*d* of the control panel 16 was pushed down and maintenance was started or when maintenance was started automatically after the prescribed interval has elapsed. If maintenance is being conducted (S70: YES), a "MAINTENANCE IS BEING CONDUCTED" message or the like is displayed on the LCD 16*b* (S72) and the processing flow returns to S10.

If maintenance is not being conducted (S70: NO), all the conditions relating to printing possibility are satisfied. Therefore, a decision is made as to whether an error is being displayed (S80). If an error is being displayed (S80: YES), an error display is turned OFF (S82), and if no error is being displayed (S80: NO), the printing possibility LED 16*e* provided in the printing start button 16*a* comes on as is (S90). The processing flow then returns to S1 and the printer waits till the printing start button 16*a* is pushed down. As described hereinabove, printing is executed if the user pushes down the printing start button 16*a* in a state in which the printing possibility LED 16*e* is ON (S1: YES, S3: YES), As explained hereinabove, with the ink-jet printer 1 of the present embodiment, conditions necessary to start printing which relate to platen installation, ink cartridge installation, residual amount of ink, waste ink tank installation, residual capacity of waste ink tank, printing data reception, and maintenance execution are checked, and the printing possibility LED 16*e* comes on when all the conditions have been satisfied. The user can start printing by checking as to whether or not the printing start button light has come on, without checking individually each printing possibility condition. Furthermore, because an error message is informed when the user erroneously pushes the printing start button before the light thereof has come on, the user may wait till the light comes on, without conducting the operations. Therefore, the printer can be easily used even by an unskilled person.

Further, in the flow chart shown in FIG. 5, the CPU 110 executing the confirmation processing of platen installation (S10), confirmation processing of ink cartridge installation (S20), confirmation processing of residual ink amount (S30), confirmation processing of waste ink tank installation (S40), confirmation processing of residual capacity of waste ink tank (S50), confirmation processing of printing data reception (S60), and confirmation processing of maintenance execution (S70) functions as the printing possibility condition decision device in accordance with the present invention. Furthermore, The CPU 110 conducting error display processing at the LCD 16*b* in S5 shown in FIG. 4 functions as the error informing device in accordance with the present invention.

The present invention is generally suitable for printing devices so constructed that the printing start command is issued at the printing unit.

The entire disclosure of the specification, claims, summary and drawings of Japanese Patent Application No. 2003-336997 filed on Sep. 29, 2003 is hereby incorporated by reference.

What is claimed is:

1. A printing apparatus for printing printing data received from external equipment, comprising:

a printing possibility condition decision device for deciding whether all of a plurality of printing possibility conditions at which printing of the printing data is possible have been satisfied;

a display device for displaying decision results obtained with said printing possibility condition decision device; and a printing start indication device for indicating a printing start, wherein:

said display device is a light-emitting member provided in said printing start indication device or in the vicinity thereof, and printing of said printing data is started after (1) the printing possibility condition decision device decides that all of the plurality of printing possibility conditions, at which printing of the printing data is possible, have been satisfied and (2) the printing start is indicated by said printing start indication device, wherein the printing start is indicated after the printing possibility condition decision device decides that all of the plurality of printing possibility conditions have been satisfied.

2. The printing apparatus according to claim 1, comprising:

a data storage device for storing said printing data, wherein said printing possibility condition decision device does not make a decision that printing is possible when at least part of the printing data has not been accumulated in said data storage device.

3. The printing apparatus according to claim 2, comprising error informing device for informing about an error in case the printing start is indicated by said printing start indication device when said printing possibility condition decision device has not decided that printing is possible.

4. The printing apparatus according to claim 1, comprising error informing device for informing about an error in case the printing start is indicated by said printing start indication device when said printing possibility condition decision device has not decided that printing is possible.

5. The printing apparatus according to claim 1, wherein the plurality of printing possibility conditions include a condition that the printing data is received from the external device, a condition that a residual amount of ink is sufficient, and a condition that the printing apparatus is not under maintenance.

6. A printing apparatus for printing printing data on cloth, comprising:

a platen for holding each piece of cloth;

a printing start indication device for indicating a print start after the cloth is placed on the platen; and a controller that:

starts a printing operation for printing on the cloth if all of a plurality of printing possibility conditions have been satisfied, and sends an error message for display if at least one of the plurality of printing possibility conditions have not been satisfied.

7. The printing apparatus according to claim 6, wherein the plurality of printing possibility conditions include a condition that the printing data is received from the external device, a condition that a residual amount of ink is sufficient, and a condition that the printing apparatus is not under maintenance.

* * * * *